US007120371B2

(12) United States Patent
Fujimori

(10) Patent No.: US 7,120,371 B2
(45) Date of Patent: Oct. 10, 2006

(54) IMAGE FORMING APPARATUS WITH HEATING MEMBERS HAVING STANDBY MODE AND LOW POWER MODE

(75) Inventor: Takashi Fujimori, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/081,723

(22) Filed: Mar. 17, 2005

(65) Prior Publication Data

US 2005/0271407 A1 Dec. 8, 2005

(30) Foreign Application Priority Data

Jun. 4, 2004 (JP) ..... 2004-167231

(51) Int. Cl.
*G03G 15/20* (2006.01)

(52) U.S. Cl. ..... 399/67; 399/70

(58) Field of Classification Search ..... 399/67, 399/69, 70

See application file for complete search history.

(56) References Cited

U.S. PATENT DOCUMENTS 5,489,761 A * 2/1996 Aslam et al. ..... 399/70
6,751,425 B1 6/2004 Fujimori et al. ..... 399/69
2003/0095280 A1 5/2003 Sunada et al. ..... 358/1.14
2004/0126127 A1 7/2004 Fujimori et al. ..... 399/70

FOREIGN PATENT DOCUMENTS

JP 01052185 A * 2/1989
JP 4-74708 3/1992
JP 2001-51533 2/2001
KR 2003039173 * 5/2003

* cited by examiner

*Primary Examiner*—David M. Gray
*Assistant Examiner*—Laura K. Roth
(74) *Attorney, Agent, or Firm*—Fitzpatrick, Cella, Harper & Scinto

(57) ABSTRACT

An image forming apparatus including an image forming unit that forms an image on a recording material, a rotating member that heats the image on the recording material by a nip portion thereof, an executing unit capable of executing a processing of rotating the rotating member at standby, a measuring unit that measures a standby time period, and a changing unit that changes a time interval of executing the processing in accordance with the standby time period.

4 Claims, 12 Drawing Sheets

FIG. 9

| | |
|---|---|
| WARM UP · STANDBY MODE | 190 |
| PRINT START MODE | 193 |
| PRINT 2 MODE | 180 |
| PRINT 3 MODE | 174 |
| PRINT 4 MODE | 164 |
| ENERGY SAVING MODE | 160 |
| EMERGENCY STOP MODE | 0 |

FIG.10

| | |
|---|---|
| STANDBY MODE | 5 MINUTES |
| ENERGY SAVING MODE | 10 MINUTES |

IMAGE FORMING APPARATUS WITH HEATING MEMBERS HAVING STANDBY MODE AND LOW POWER MODE

BACKGROUND OF THE INVENTION

1. Field of the Invention

The present invention relates to an image forming apparatus using an electrophotography system, particularly relates to an image forming apparatus of a copier, a printer, a facsimile or the like.

2. Description of the Related Art

As an image forming apparatus adopting an electrostatic recording system or an electrophotography recording system, a copier, a printer, a facsimile apparatus or the like has been known. As an image forming apparatus of this kind, there is widely used a so-called roller type fixing apparatus for fixing a toner image onto a sheet by a pair of rollers brought into press contact with each other. According to the roller type fixing type apparatus, by bringing a fixing roller and a pressing roller of silicone rubber or the like into press contact with each other, a nip in a planar shape is formed at a contact face of the two rollers and fixing is executed by applying pressure and heat to the sheet at the nip portion.

At the nip portion, a rubber structure of the two rollers is always subjected to compressive strain. Therefore, when a stationary state of the fixing roller is continued for a long period of time, bonding of the rubber structure may be destructed by exceeding a plastic limit and the strain may not be recovered to nullify. Such a state is referred to as a compression set (compressive permanent set). The rubber roller causing the compression set is bent and therefore, the rubber roller cannot form an image or carry the sheet correctly in the fixing apparatus, and jamming, color shift, sheet skewing or the like is brought about. Hence, there has been proposed a method of preventing the compression set by shifting the nip position by rotating the rollers at constant time intervals in a standby mode in which the fixing roller is stationary (Japanese Patent Unexamined publication No. HEI 4-74708).

Meanwhile, in recent years, as is seen also in international standards of energy star and the like, reduction and the efficient formation of power consumption of a power consuming apparatus has strongly been promoted. Also an image forming apparatus is not exceptional and there has been devised an apparatus of adopting a measure of reducing power consumption of shifting from a standby mode to an energy saving mode of reducing power consumption when the image forming apparatus is not operated for a constant period of time in a standby mode in order to reduce power consumption at standby.

For example, when the above-described nip position change control executed at constant time intervals is adopted in such an energy saving mode, since an initial temperature of the fixing roller in shifting to the energy saving mode is not taken into consideration, there is a case in which a frequency of executing nip position change operation becomes excessively large or a case in which the frequency becomes excessively small. That is, there is a possibility that the nip position change operation is not carried out efficiently and properly.

SUMMARY OF THE INVENTION

It is an object of the invention to provide an image forming apparatus capable of efficiently executing a processing of rotating a rotating member at standby.

It is other object of the invention to provide an image forming apparatus capable of prolonging service life of parts for rotating a rotating member at standby.

It is other object of the invention to provide an image forming apparatus capable of making restraint of deterioration in a rotating member and a reduction in power consumption compatible with each other by a simple constitution.

A further object of the invention will become apparent by reading the following detailed description in reference to the attached drawings.

According to a first aspect of the invention, there is provided an image forming apparatus comprising:

an image forming unit that forms an image on a recording material;

a rotating member that heats the image on the recording material by a nip portion thereof;

an executing unit capable of executing a processing of rotating the rotating member at standby;

a measuring unit that measures a standby time period; and a changing unit that changes a time interval of executing the processing in accordance with the standby time period.

BRIEF DESCRIPTION OF THE DRAWINGS

FIG. 9 is a diagram showing an example of a control target temperature table;

FIG. 10 is a diagram showing an example of an interval table;

DESCRIPTION OF THE PREFERRED EMBODIMENTS

First, a simple explanation will be given of an outline of a nip position change control in an image forming apparatus according to an embodiment of the invention.

Figure 1:
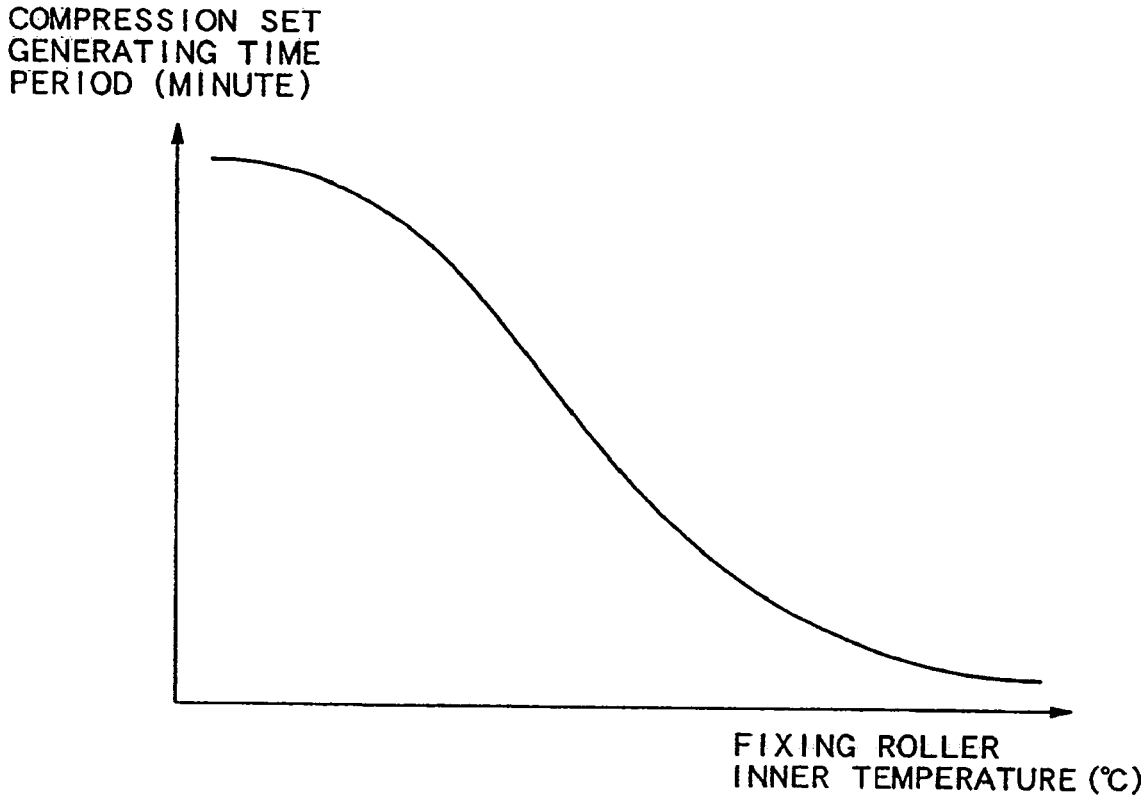
FIG. 1 is a graph showing a relationship between a temperature of a fixing roller and a time period of generating a compressive permanent strain.

FIG. 1 shows a relationship between a temperature of a fixing roller (abscissa) and a time period of generating a compression set (ordinate). As is known from the graph, the larger the heat amount provided to the fixing roller (that is, the higher the temperature of the fixing roller), the shorter the time period of changing a compressive strain of the fixing roller to a compression set.

A temperature of the fixing roller in an energy saving mode as a low power mode (control target temperature) is set to a value lower than that in a standby mode and therefore, also a time period of generating the compression set in the energy saving mode becomes longer than that in the standby mode. Therefore, when considered simply, an interval (executing time interval) of the nip position change operation (also referred to as "compression set preventing rotational operation") in the energy saving mode may simply be set to be longer than that in the standby mode.

However, as a result of investigation by the inventor, it has been found that the following problem is posed by such a simple control. When the standby mode is switched to the energy saving mode, a control temperature of the fixing roller is changed from a standby mode setting temperature (first temperature) to an energy saving mode setting temperature (second temperature). However, at this occasion, an actual temperature of the fixing roller is not immediately lowered to the second temperature but gradually changed from the first temperature to the second temperature.

Figure 2:
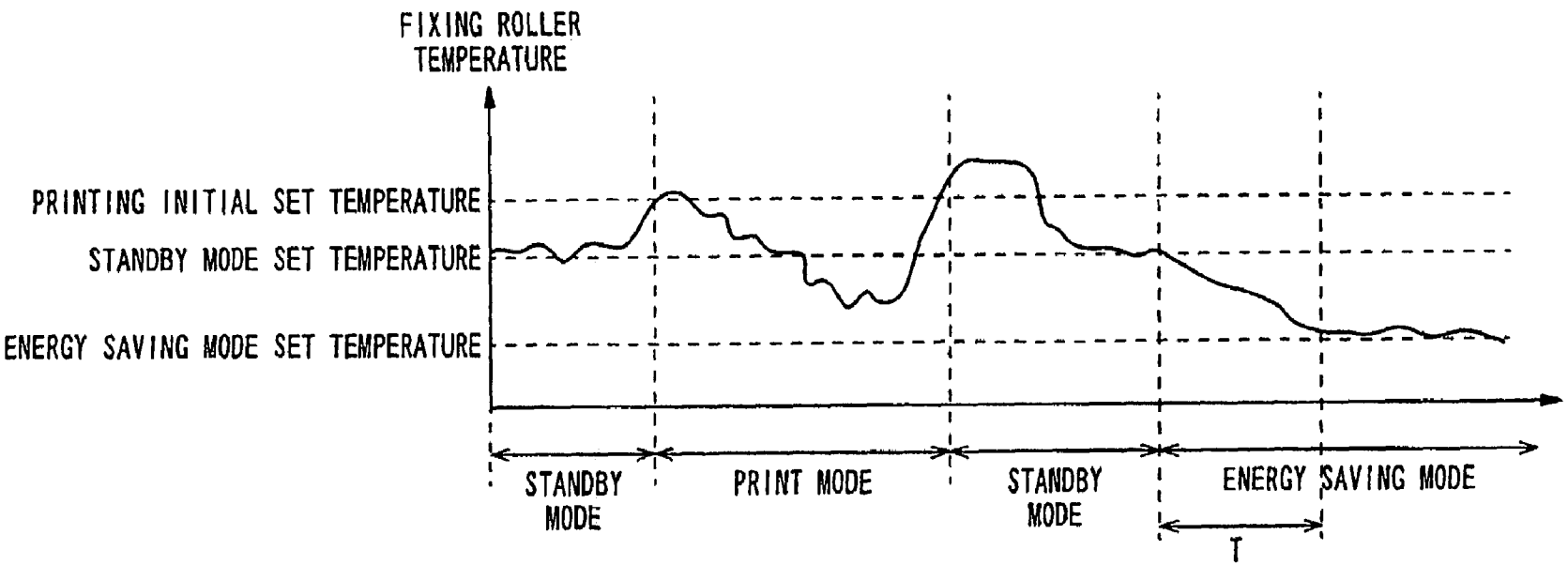
FIG. 2 is a graph showing a transition of a state of an image forming apparatus and the temperature of the fixing roller.

FIG. 2 shows a transition of a state of the image forming apparatus (abscissa) and a detected temperature of the fixing roller (ordinate; bold line) and a control target temperature of the fixing roller is shown by a broken line of the abscissa.

It is known from the graph that a time period T is required until the temperature of the fixing roller is brought into a substantially equilibrium state at the second temperature. Therefore, when a nip position change interval is immediately switched from a value thereof for the first temperature in the standby mode to a value thereof for the second temperature in the energy saving mode simultaneously with switching from the standby mode to the energy saving mode, there is a concern of generating the compression set during a section of time until elapse of the time period T from time of switching the mode.

Hence, according to this embodiment, the interval of switching the nip position change operation is not switched simultaneously with switching from the standby mode to the energy saving mode but the interval is changed in consideration of a transition from the first temperature to the second temperature of the fixing roller. Thereby, even during the section of time until the temperature of the fixing roller reaches the second temperature after switching from the standby mode to the energy saving mode, the nip position change operation can be executed at a pertinent timing capable of restraining the compression set. Further, since a frequency of the nip position change operation can be optimized, the restraint of the compression set and the reduction in the power consumption at standby can be made to be compatible with each other. Further, a load on parts constituting a drive power source for driving the fixing roller can be alleviated.

The interval of executing the nip position change operation is changed in accordance with an elapsed time period after switching from the standby mode to the energy saving mode. Specifically, there is adopted a method of changing the interval of executing the nip position change operation to be prolonged in steps in accordance with the elapsed time period. Therefore, an influence of noise becomes difficult to be effected than in a constitution of changing the executing interval in accordance with the detected temperature (analog value) of the fixing roller and the processing can be simplified since there is only needed a control of a timer of measuring the elapsed time period. Further, a correlation between the elapsed time period and the change of the roller temperature is previously provided by an experiment or the like.

Figure 3:
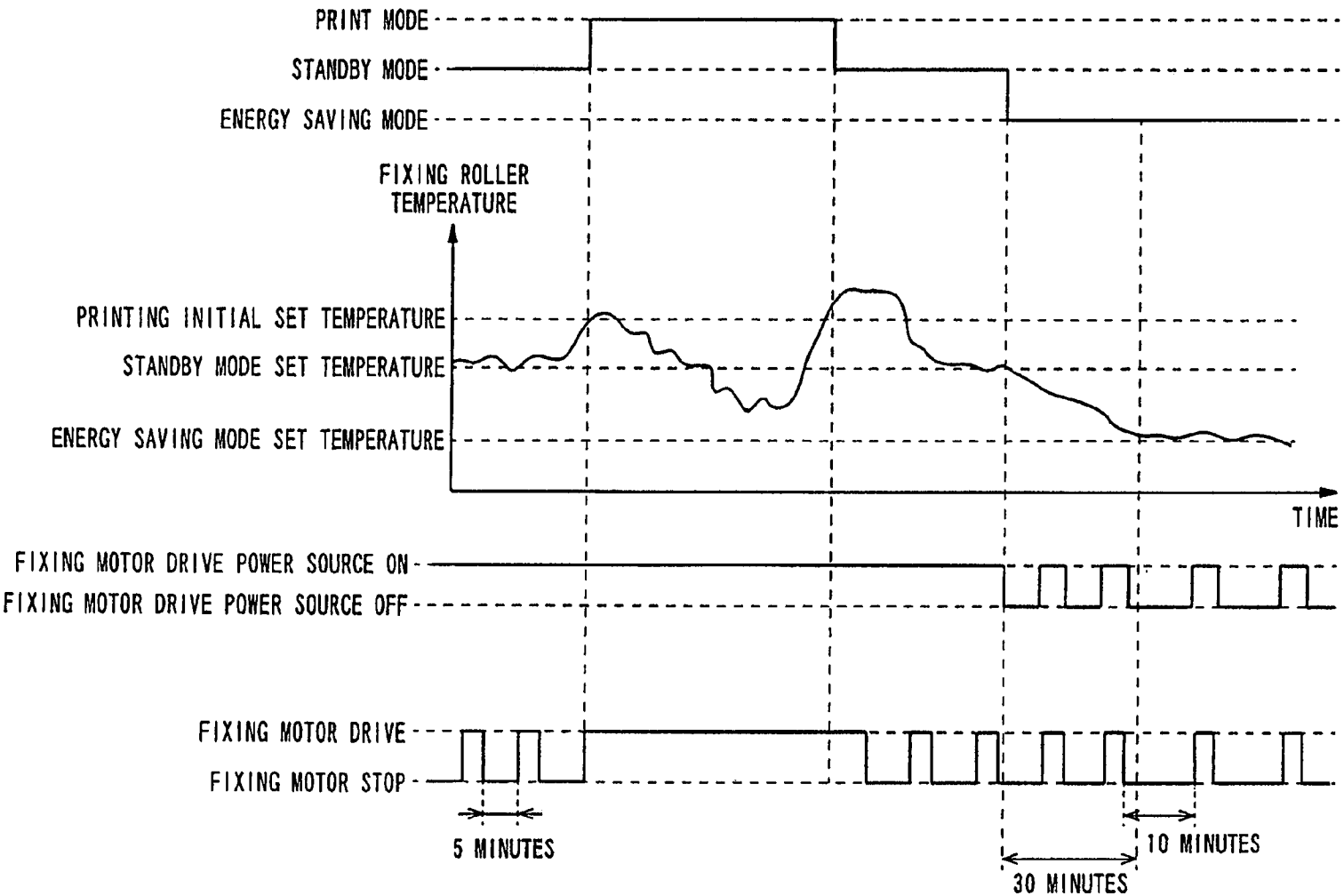
FIG. 3 illustrates timing charts showing an example of a nip position change control.

FIG. 3 shows an example of the nip position change control according to the embodiment of the invention. The drawing illustrates time charts showing the nip position change control when the mode is successively switched such that standby mode→print mode→standby mode→energy saving mode.

(1) In the standby mode, by controlling an amount of current through a fixing heater 105, mentioned later, the temperature of the fixing roller is maintained at the standby mode setting temperature (first temperature) capable of forming an image (capable of executing a fixing processing) At this occasion, a drive power source for driving a fixing motor as driving means is normally made to be ON to bring about a state of capable of starting the fixing motor at any time. Further, under control by a CPU 501 as an executing unit, the fixing motor drives the fixing roller to execute the nip position change operation at an interval of 5 minutes.

(2) In the print mode, since the fixing roller is normally rotated and therefore, the nip position change operation is not needed.

(3) Printing is finished, the print mode is switched to the standby mode by the CPU 501, and the fixing motor is stopped to stop rotating the fixing roller. Further, similar to (1), the nip position change operation is executed at the interval of 5 minutes.

(4) When a predetermined time period has elapsed while staying in the standby mode, the mode is switched to the energy saving mode automatically by the CPU 501. In the energy saving mode, the drive power source for the fixing motor is shut off to bring about the state in which a more time period is required for starting the fixing motor than in the standby mode. Further, a timer is started and an elapsed time period from a time point of switching the mode is started to measure. When the elapsed time period is less than 30 minutes, the drive power source for the fixing motor is started up at an executing interval of 5 minutes equal to that in the case of the standby mode, the nip position change operation is successively executed, and after finishing the nip position change operation, the drive power source is shut off to bring about the state of the energy saving mode again. Further, when 30 minutes or more has elapsed, the interval is changed to 10 minutes and thereafter, the nip position change operation is executed at the interval of 10 minutes.

Now, a detailed explanation will be given of a specific constitution of the image forming apparatus executing the above-described control.

<Constitution of Image Forming Apparatus>

Figure 4:
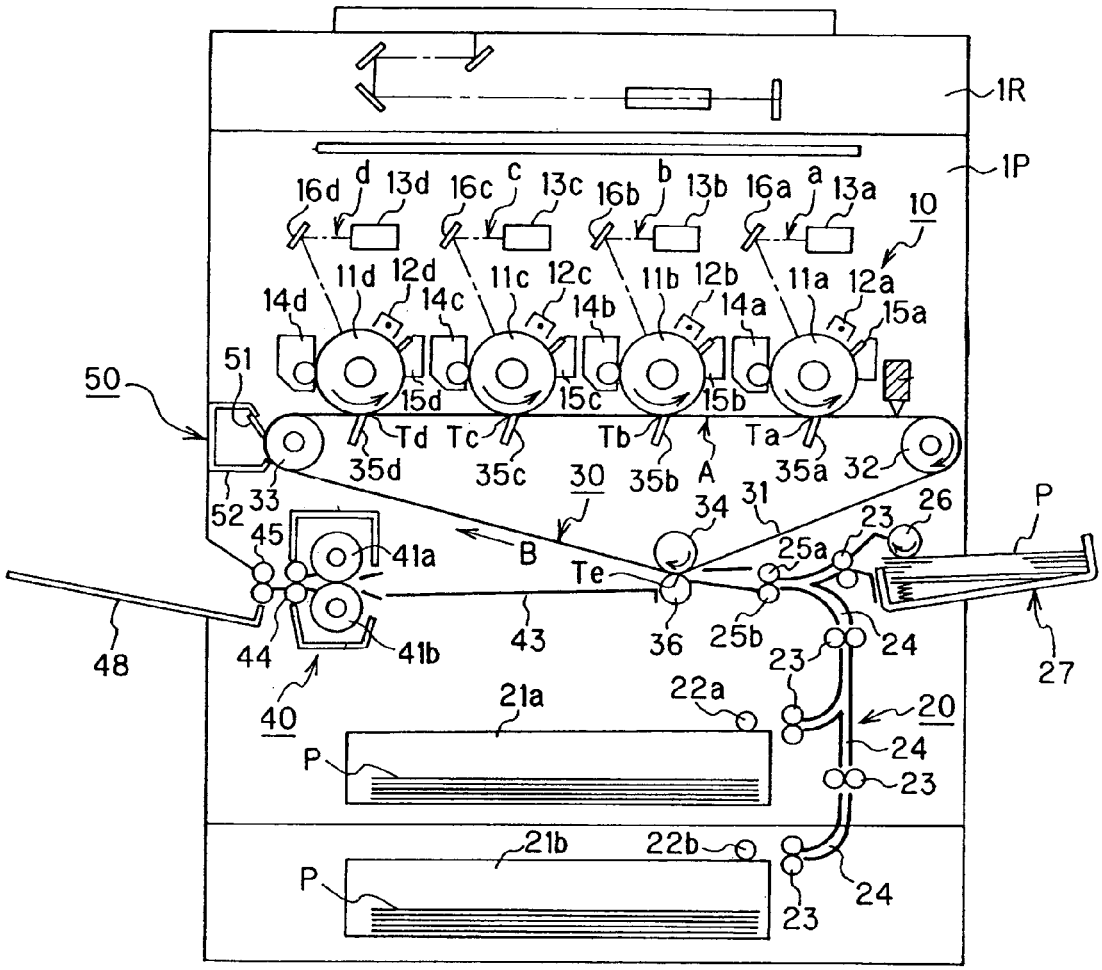
FIG. 4 is a sectional view showing a constitution of the image forming apparatus.

FIG. 4 shows a constitution of the image forming apparatus according to the embodiment of the invention. The image forming apparatus is a copier of an electrophotography recording system and is constituted by a document reading portion 1R for reading an image of a document and an image outputting portion 1P for outputting an image to a sheet (recording material).

The image outputting portion 1P is constituted by an image forming unit 10 (in which four stations a, b, c, d are installed in parallel and constitutions thereof are the same), a sheet feeding unit 20, an intermediate transferring unit 30, a fixing unit 40 and a control unit (FIG. 6) in gross classification.

The image forming unit 10 is constructed by a constitution described below. Photosensitive drums 11*a*, 11*b*, 11*c*, and 11*d* as image bearing members are axially supported at centers thereof and driven to rotate in arrow mark directions. Surroundings of the photosensitive drums 11*a* through 11*d* are arranged with primary chargers 12*a*, 12*b*, 12*c*, and 12*d*, optical systems 13*a*, 13*b*, 13*c*, and 13*d*, reflecting mirrors

16*a*, 16*b*, 16*c* and 16*d* and developing devices 14*a*, 14*b*, 14*c*, and 14*d* along rotational directions of the photosensitive drums.

The sheet feeding unit 20 comprises cassettes 21*a*, 21*b* for containing a sheet P, a hand setting tray 27, pick up rollers 22*a*, 22*b*, and 26 of feeding the sheets P sheet by sheet from inside of the cassettes or the hand setting tray, sheet feed roller pairs 23 and sheet feed guides 24 for conveying the sheets P fed out from the respective pickup rollers to register rollers, and register rollers 25*a*, 25*b* for feeding the sheets P to a secondary transferring region Te in accordance with a timing of forming the image in the image forming unit.

The intermediate transferring unit 30 will be explained in details. An intermediate transferring belt 31 is an intermediate transferring member produced from a material of, for example, PET [polyethyleneterephthalate] or PVdF [polyvinyl fluoride].

The intermediate transferring belt 31 is wound around a drive roller 32 for transmitting a drive force in the direction of arrow B to the intermediate transferring belt 31, a tension roller 33 for exerting a pertinent tension to the intermediate transferring belt 31 by being urged by a spring (not illustrated), and a driven roller 34 opposed to the secondary transferring region Te by interposing the belt. Among them, a primary transferring plane A is formed between the drive roller 32 and the tension roller 33. The drive roller 32 prevents slip relative to the belt by coating rubber (urethane or chloroprene) having a thickness of several mm on a surface of a metal roller. The drive roller 32 is driven to rotate by a pulse motor (not illustrated).

Primary transferring regions Ta through Td constituting portions of bringing the respective photosensitive drums 11*a* through 11*d* and the intermediate transferring belt 31 into contact with each other are arranged with primary transferring blades (primary transferring chargers) 35*a* through 35*d* on a rear side of the intermediate transferring belt 31.

A secondary transferring roller 36 is arranged to be opposed to the driven roller 34 to form the secondary transferring region Te by a nip between the intermediate transferring belt 31 and the secondary transferring roller 36. The secondary transferring roller 36 is pressed to the intermediate transferring belt 31 by a pertinent pressure.

A cleaning device 50 for cleaning an image forming face of the intermediate transferring belt 31 is arranged on the intermediate transferring belt and on a downstream side of the secondary transferring region Te. The cleaning device 50 comprises a cleaner blade 51 (polyurethane rubber or the like is used as a material therefor) and a waste toner box 52 for containing waste toner.

The fixing unit (fixing means) 40 is provided with a fixing roller (rotating member) 41*a* and a pressing roller (second rotating member) 41*b* constituting a pair of rotating members brought into press contact with each other. Further, the fixing unit 40 is provided with a guide 43 for guiding the sheet P to the nip portion of the roller pair, inner sheet discharge rollers 44, outer sheet discharge rollers 45 for guiding the sheet P discharged from the roller pair further to a tray 48 outside of the apparatus.

The control unit comprises a control board for controlling operation of mechanisms in the respective units and a motor drive board.

Further, a detailed explanation will be given of data of the fixing unit 40 and the control unit in reference to other drawings.

<Image Forming Operation>

Next, image forming operation will be explained by taking an example of a case of forming an image on the sheet P contained in the cassette 21*a*.

When an image forming operation start signal is generated, first, the sheet P is fed out sheet by sheet from the cassette 21*a* by the pickup roller 22*a*. Further, the sheet P is conveyed to the register rollers 25*a*, 25*b* by the sheet feed roller pairs 23 by being guided between the sheet feed guides 24. At this occasion, the register rollers are brought into a stationary state and a front end of the sheet is butted to the nip portion. Thereafter, the register rollers 25*a* and 25*b* start rotating in accordance with a timing of starting to form an image by the image forming unit 10. The rotation start timing is set such that the sheet P and the toner image primarily transferred on the intermediate transferring belt 31 by the image forming unit 10 precisely coincide with each other at the secondary transferring region Te.

Meanwhile, at the image forming unit 10, when an image forming operation start signal is generated, the primary chargers 12*a* through 12*d* apply charge to the photosensitive drums 11*a* through 11*d* to charge surfaces thereof uniformly. Successively, by exposing light ray (for example, laser beam) modulated by the optical system 13*a* through 13*d* in accordance with record image signals on the photosensitive drums 11*a* through 11*d*, an electrostatic latent image is formed there. Further, the developing devices 14*a* through 14*d* respectively containing 4 colors of developers (toners) of yellow, cyan, magenta, black visualize the electrostatic latent image. The visualized visible image is transferred onto the intermediate transferring member at the image transferring regions Ta, Tb, Tc, and Td. On the downstream side of the image transferring regions Ta through Td, the cleaning device 15*a*, 15*b*, 15*c*, and 15*d* scrape off the toners remaining on the photosensitive drums 11*a* through 11*d* without being transferred onto the intermediate transferring member to clean the surfaces of the drums. By the above-described process, the image is successively formed by the respective toners.

Further, the toner image formed on the photosensitive drum 11*d* disposed on the uppermost side in the rotational direction of the intermediate transferring belt 31 is primarily transferred onto the intermediate transferring belt 31 at the primary transferring region Td by the primary transferring blade 35*d* applied with a high voltage. The primarily transferred toner image is carried to the successive primary transferring region Tc. At the station c, the image is formed by being delayed from the station d by a time period of carrying the toner image. Therefore, at the primarily transferring region Tc, the successive toner image is transferred on the previously transferred toner image by matching a resist thereof. Similar steps are repeated as follows, as a result, 4 colors of the toner images are overlapped on the intermediate transferring belt 31.

A high voltage is applied on the secondary transferring roller 36 in accordance with a timing of advancing the sheet P to the secondary transferring region Te. Further, 4 colors of the toner images formed on the intermediate transferring belt are transferred onto the surface of the sheet P. Thereafter, the sheet P is guided to the nip portion of the fixing unit 40 by the carry guide 43. Further, heat and pressure are applied to the nip portion of the fixing roller 41*a* and the pressing roller 41*b* and the toner image is fixed onto the surface of the sheet. Thereafter, the sheet P is conveyed by the inner and outer sheet discharging rollers 44, 45 to discharge outside of the apparatus.

<Constitution of Fixing Unit>

Figure 5:
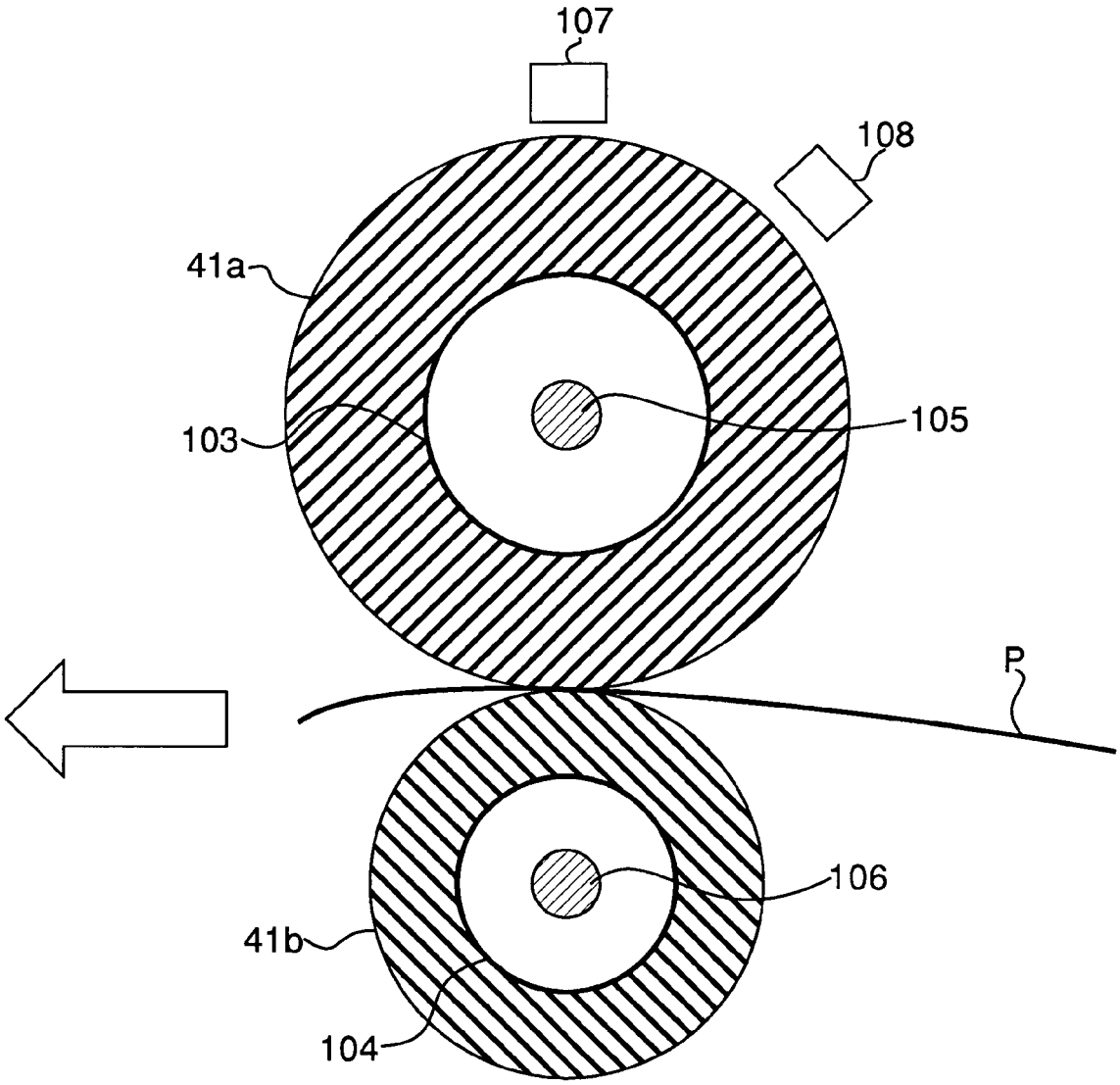
FIG. 5 is a sectional view showing a constitution of a fixing unit.

FIG. 5 shows a section of the roller pair of the fixing unit 40.

The fixing roller 41*a* is a rubber roller and comprises a core metal 103 in a cylindrical shape and a rubber layer wrapped around the core metal 103. Further, also the pressing roller 41*b* is a rubber roller and comprises a core metal 104 in a cylindrical shape and a rubber layer as an elastic layer wrapped around the core metal 104. Silicone rubber or the like is preferable for a material of the rubber layer and a layer thickness thereof is formed to be comparatively thick. As a material of the core metals 103 and 104, a material having an excellent heat conductivity of stainless steel, aluminum, copper or the like is preferable. The fixing roller and the pressing roller are brought into a state of being brought into press contact with each other by a predetermined pressure to form the fixing nip portion. Further, there is constructed a constitution that the pressing roller brought into press contact with the fixing roller is driven to rotate by driving to rotate the fixing roller by a fixing drive motor. That is, the pressing roller is also rotated along with the fixing roller by the nip position change operation, mentioned later.

The fixing heater 105 constituting a first heating source is provided at an inner portion of the fixing roller 41*a*. A halogen heater can preferably be adopted for the fixing heater 105. The fixing heater 105 generates heat by conducting electricity to warm the core metal 103. The core metal 103 serves to warm the fixing roller 41*a* by transferring heat supplied by the fixing heater 105 to the fixing roller 41*a*.

A temperature holding heater 106 constituting a second heating source is provided at an inner portion of the pressing roller 41*b*. That is, the fixing unit 40 according to the embodiment includes the plurality of heating sources (fixing heater 105, temperature holding heater 106) for heating the rotating members (fixing roller 41*a*, pressing roller 41*b*). It is preferable to adopt a halogen heater also for the temperature holding heater 106.

A surrounding of the fixing roller 41*a* is arranged with a first surface temperature sensor 107 and a second surface temperature sensor 108. The first surface temperature sensor 107 measures a surface temperature at a center portion in an axial direction of the fixing roller 41*a*.

The control unit maintains the temperature of the fixing roller 41*a* to be at a predetermined control temperature by controlling to switch ON/OFF the fixing heater 105 based on output of the first surface temperature sensor 107.

The second surface temperature sensor 108 measures a surface temperature of an end portion in the axial direction of the fixing roller 41*a*.

The second surface temperature sensor 108 serves to prevent the fixing unit 40 from being failed beforehand by excessively heating the fixing roller 41*a* when the surface temperature cannot correctly be measured by a failure of the first surface temperature sensor 107.

<Control Unit>

Figure 6:
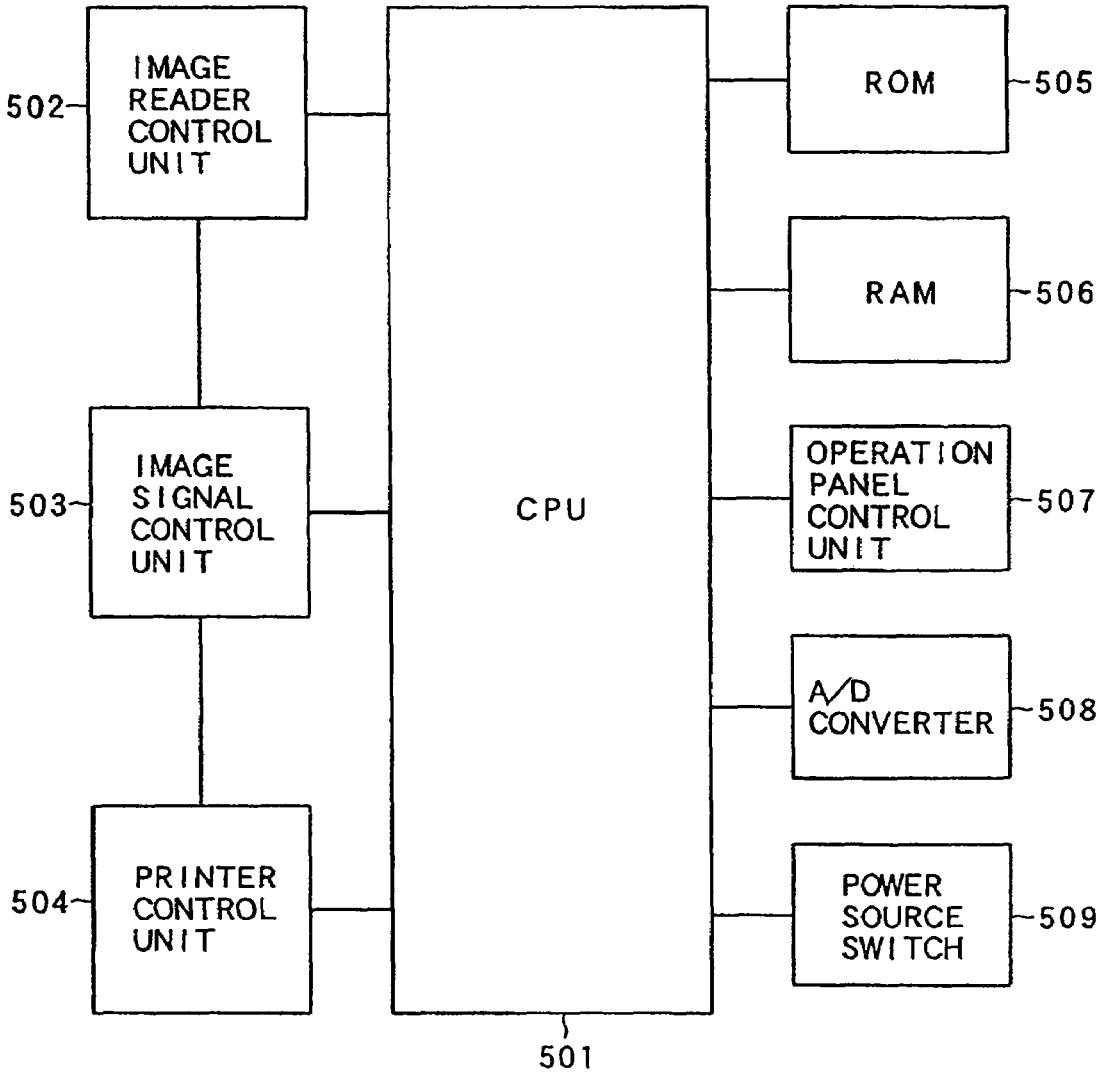
FIG. 6 is a block diagram showing a constitution of a control unit.

FIG. 6 is a block diagram showing a constitution of the control unit for controlling the image forming apparatus of the embodiment. The control unit is provided with the CPU (central processing unit) 501, an image reader control unit 502, an image signal control unit 503, a printer control unit 504, a ROM (read only memory) 505, a RAM (random access memory) 506, an operation panel control unit 507, an A/D converter 508, a power source switch 509.

The CPU 501 controls the document reading portion 1R via the image reader control unit 502 by executing a program stored in the ROM 505. The image signal control unit 503 stores image data of a document read by the document reading portion 1R, or image data inputted via a network and outputs print data to the printer control unit 504. The CPU 501 controls an operation panel (not illustrated) via the operation panel control unit 507. The CPU 501 detects the surface temperature of the fixing roller 41*a* by converting an analog output of the first and the second surface temperature sensor 107 and 108 into digital data by the A/D converter 508. Further, the CPU 501 pertinently controls to supply/cut power for driving respective constituent elements including the fixing unit 40 by starting up/shutting off the fixing motor drive power source by the power source switch 509.

Figure 7:
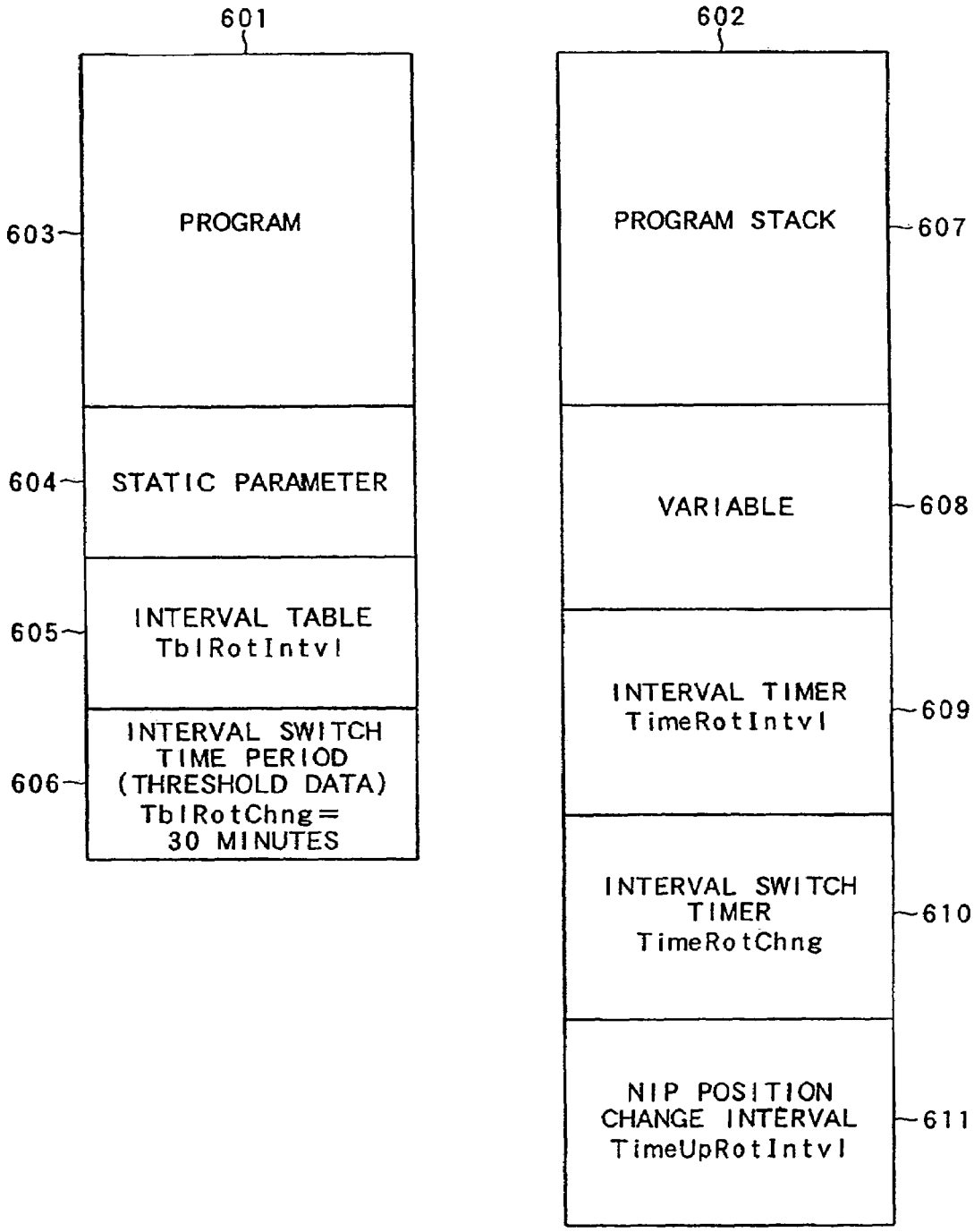
FIG. 7 is a diagram showing allocation of areas of a ROM and a RAM.

FIG. 7 shows allocation of areas of the ROM 505 and RAM 506.

A storage area 601 of the ROM 505 includes a program area 603 stored with a program, a static parameter area 604 stored with a static parameter necessary for executing the program, an area 605 stored with an interval table (TblRotIntvl) registered with a plurality of nip position change (compression set preventing rotation) intervals, and an area 606 stored with switch time period (threshold data) of the nip position change interval (TblRotChng). According to the embodiment, as an example of the switch time period TblRotChng, a value of "30 minutes" is stored.

A storage area 602 of the RAM 506 includes a stack area 607 and a variable area 608 necessary for executing a program, an area 609 for an interval timer (TimeRotIntvl) used for counting an elapsed time period from executing the nip position change operation at a preceding time, an area 610 for an interval switch timer (TimeRotChng) for counting an elapsed time period after switching the standby mode to the energy saving mode, and an area 611 for counting up time stored with a value of a nip position change interval (TimeUpRotIntvl). The interval timer TimeRotIntvl is a timer for counting a timing of executing the nip position change operation and the interval switch timer TimeRotChng is a timer for counting a value of the nip position change interval TimeUpRotIntvl, that is, a timing of changing an interval of executing the nip position change operation.

<Temperature Control of Fixing Unit>

Figure 8:
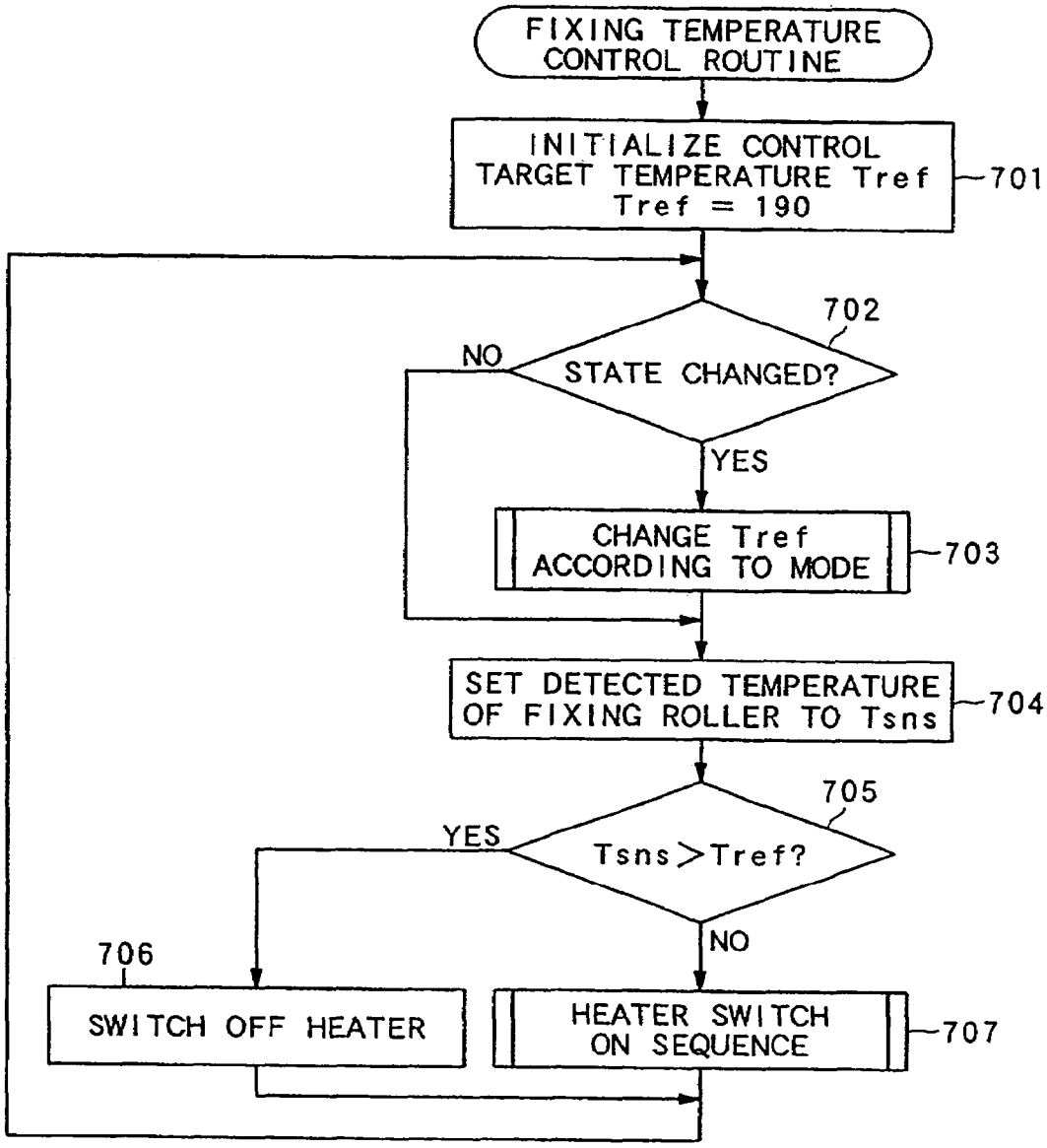
FIG. 8 is a flowchart showing a temperature control algorithm.

FIG. 8 is a flowchart showing a temperature control algorithm of the fixing unit. The processing is executed by the CPU 501 (program).

When the power source of the image forming apparatus is switched on, an initial value of "190° C." is stored to a control target temperature storing variable Tref (step 701). When a state (mode) of the image forming apparatus is changed (step 702), a control target temperature in accordance with the mode is read from a control target temperature table and the value of the control target temperature is stored to the variable Tref (step 703).

FIG. 9 shows an example of the control target temperature table. The table defines relations between modes of the image forming apparatus and control target temperatures (set temperatures). The image forming apparatus of the embodiment includes a warm up mode of a state of operating to prepare printing, a standby mode of a printable state, a print mode of a state of executing printing, an energy saving mode of a state of minimizing power consumption, and an emergency stop mode.

The print mode includes a print start mode, a print 2 mode, a print 3 mode and a print 4 mode which are shifted in steps in accordance with an elapsed time period from starting to print.

Further, set temperatures in correspondence with the respective modes are "190° C." in the warm up mode or the standby mode, "193° C." in the print start mode, "180° C.", "174° C.", "164° C." successively in the print 2 mode through print 4 mode, "160° C." in the energy saving mode and "0° C." in the emergency stop mode.

The set temperature of the energy saving mode is set to a value which is lower than the printable temperature (about 170° C.) but can reach the printable temperature in a short period of time by applying comparatively small energy.

After setting the control target temperature to the variable Tref, an output value (detected temperature) of the first surface temperature sensor 107 provided via the A/D converter 508 is stored to a variable Tsns (step 704). Next, the value of the variable Tsns (detected temperature) is compared with the value of the variable Tref (control target temperature) (step 705). When the detected value is equal to or lower than the control target temperature, the fixing heater 105 and the temperature holding heater 106 are lighted by executing a heater lighting sequence (step 707). On the other hand, when the detected temperature is higher than the control target temperature, the fixing heater 105 and the temperature holding heater 106 are not lighted (step 706).

By the above-described temperature control, the fixing roller 41*a* and the pressing roller 41*b* of the fixing unit 40 are controlled to a pertinent temperature in accordance with the mode.

In the standby mode, the temperature of the fixing roller of the fixing unit 40 is maintained at 190° C. (first temperature) capable of forming the image and therefore, the image forming can immediately be executed.

Further, in the energy saving mode, the temperature is maintained at 160° C. (second temperature) lower than the first temperature and therefore, power consumption can be restrained to be low. Further, the second temperature is only slightly lower than the printable temperature and therefore, when the image forming start signal is inputted, energy required for recovering from the energy saving mode can be reduced and a power consumption efficiency as a whole can also be promoted. Further, the mode can be recovered in the short period of time and therefore, a recovery waiting time period can also be reduced, which amounts to promote convenience.

Further, since the fixing unit 40 includes two heating sources of the fixing heater 105 and the temperature holding heater 106, it is preferable to use the two heaters for heating the respective rollers in the standby mode, the print mode or the like having high set temperatures and use only one of the heaters (for example, fixing heater 105) in the energy saving mode having a low set temperature. By reducing a number of the heating sources of supplying power, power consumption in the energy saving mode can further be reduced.

<Nip Position Change Control>

FIG. 10 shows an example of the interval table TblRotIntvl (605 of FIG. 7) stored in the ROM 505. The table defines relations between the modes of the image forming apparatus and the executing intervals of the nip position change operation. According to the example, a value of "5 minutes" is set as an executing interval in the standby mode and a value of "10 minutes" is set as an executing interval in the energy saving mode.

Figure 11:
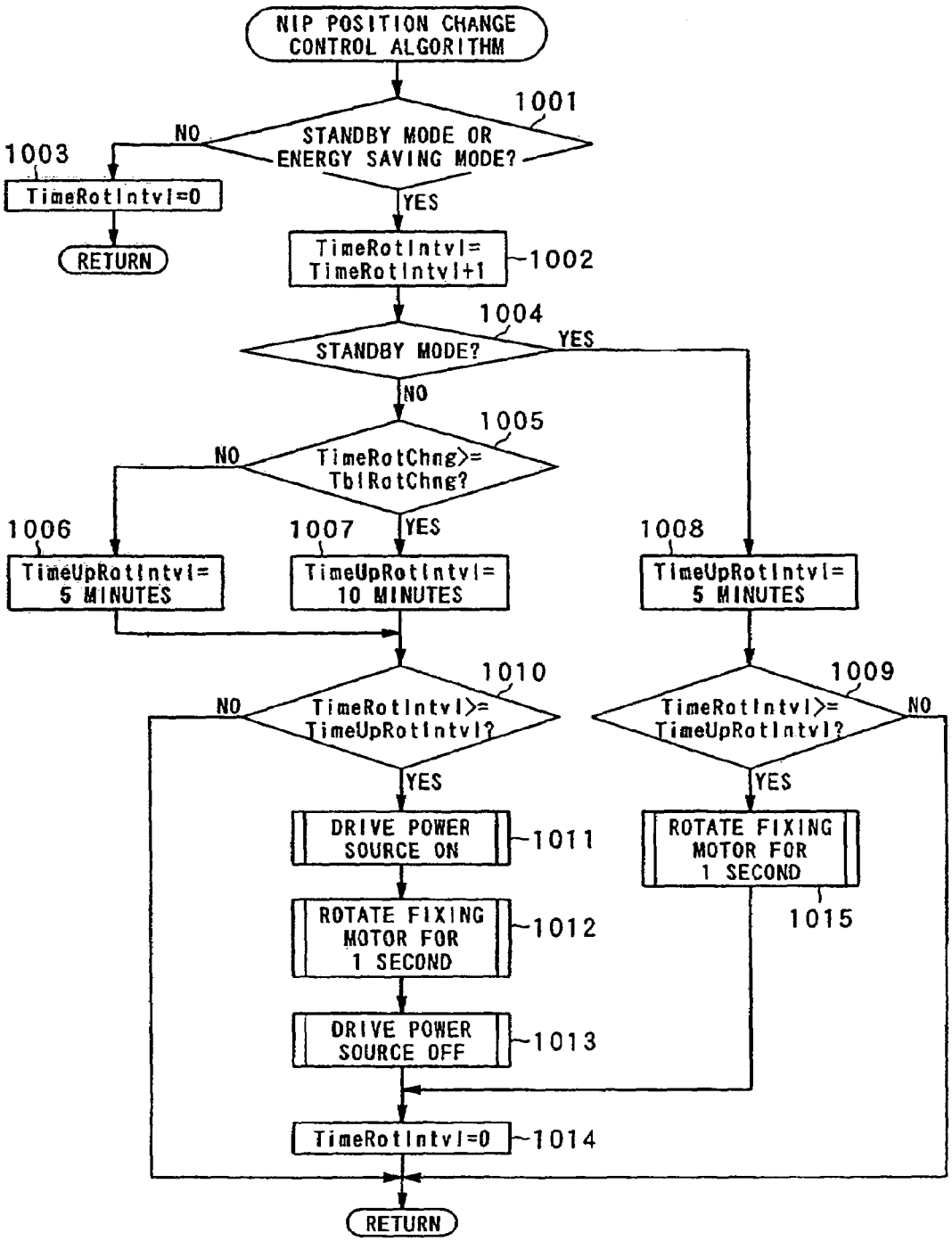
FIG. 11 is a flowchart showing a nip position change control algorithm.

FIG. 11 is a flowchart showing a nip position change control algorithm. The processing is executed by the CPU 501 (program) as an executing unit repeatedly at constant time intervals. The function of the CPU 501 corresponds to control means as the example.

First, it is confirmed whether the current mode of the image forming apparatus is the standby mode or the energy saving mode (step 1001).

When the mode is not the standby mode or the energy saving mode, there is brought about a state in which the fixing motor is rotated in printing or in warming up, or a state in which the fixing heater is not lighted by the emergency stop of jamming or the like. In this case, it is not necessary to execute the nip position change operation (compression set preventing rotation) and therefore, the interval timer TimeRotIntvl is reset to 0 and the operation is finished (step 1003).

In the case of the standby mode or the energy saving mode, the interval timer TimeRotIntvl is incremented by 1 (step 1002). Further, the processing branches depending on whether the mode is the standby mode or the energy saving mode (step 1004).

(Case of Standby Mode)

In the case of the standby mode, an interval for the standby mode is read from the interval table TblRotIntvl and the interval value of "5 minutes" is set to the nip position change interval TimeUpRotIntvl (step 1008). Successively, it is determined whether the value of the interval timer TimeRotIntvl reaches the value of the nip position change interval TimeUpRotIntvl (step 1009), and when the value is reached, the fixing motor is rotated for 1 second (step 1015), the interval timer TimeRotIntvl is reset and the operation is finished (step 1014). However, when the value of the interval timer TimeRotIntvl is smaller than the value of the nip position change interval TimeUpRotIntvl, the operation is finished as it is.

By such a processing, in the standby mode, the nip position change operation is executed at the interval of 5 minutes and the compression set is restrained from being brought about.

Although the set value to the nip position change interval TimeUpRotIntvl is described as "5 minutes" to facilitate to understand the explanation, in an actual program, a "value corresponding to 5 minutes" is set in accordance with a unit of counting by the interval timer TimeRotIntvl. For example, when the processing of FIG. 11 is executed once per second, the time is counted up for each second and therefore, the nip position change interval TimeUpRotIntvl is set with a value of "300 (=5×60 seconds)".

(Case of Energy Saving Mode)

In the case of the energy saving mode, first, it is determined whether the value of the interval switch timer TimeRotChng reaches the value of the switch time period TblRotChng of the nip position change interval (step 1005). The interval switch timer TimeRotChng is a value measured by an elapsed time measuring algorithm, mentioned later, and corresponds to an elapsed time period after switching from the standby mode to the energy saving mode. Further, the switch time period TblRotChng is a threshold for defining a timing of changing the nip position change interval TimeUpRotIntvl. By the processing of step 1005, it is determined whether the elapsed time period from the time point of switching from the standby mode to the energy saving mode elapses for 30 minutes or longer.

When the elapsed time period is less than 30 minutes, the CPU 501 (functioning as a changing unit) reads an interval for the standby mode from the interval table TblRotIntvl and sets the interval value of "5 minutes" to the nip position change interval TimeUpRotIntvl (step 1006).

When the elapsed time period is 30 minutes or longer, the CPU 501 sets an interval value of "10 minutes" for the energy saving mode (step 1007). That is, the nip position change operation is executed at the interval (5 minutes) equal to that of the case of the standby mode during a time period until 30 minutes is elapsed since the mode has been switched to the energy saving mode and thereafter at the interval (10 minutes) longer than the case of the standby mode thereafter.

Successively, it is determined whether the value of the interval timer TimeRotIntvl reaches the value of the nip position change interval TimeUpRotIntvl (step 1010). When the value is reached, first, the drive power source for the fixing motor is started up (step 1011), the fixing motor is rotated for 1 second (step 1012) and thereafter, the drive power source is shut off again (step 1013). Further, the interval timer TimeRotIntvl is reset and the operation is finished (step 1014). On the other hand, when the value is not reached, the operation is finished as it is without executing the nip position change operation.

Since a time period of rotating the fixing motor in the nip position change operation is set to 1 second, the fixing roller is rotated by one eighth turn and the nip position is properly changed. That is, the rotational angle of the fixing roller in the nip position change operation is about 45°, which is smaller than 360°.

By such a nip position change control, the nip position of the fixing roller and the pressing roller is shifted at each predetermined time interval and therefore, the compression set is restrained from being brought about.

<Elapsed Time Period Measuring Algorithm>

Figure 12:
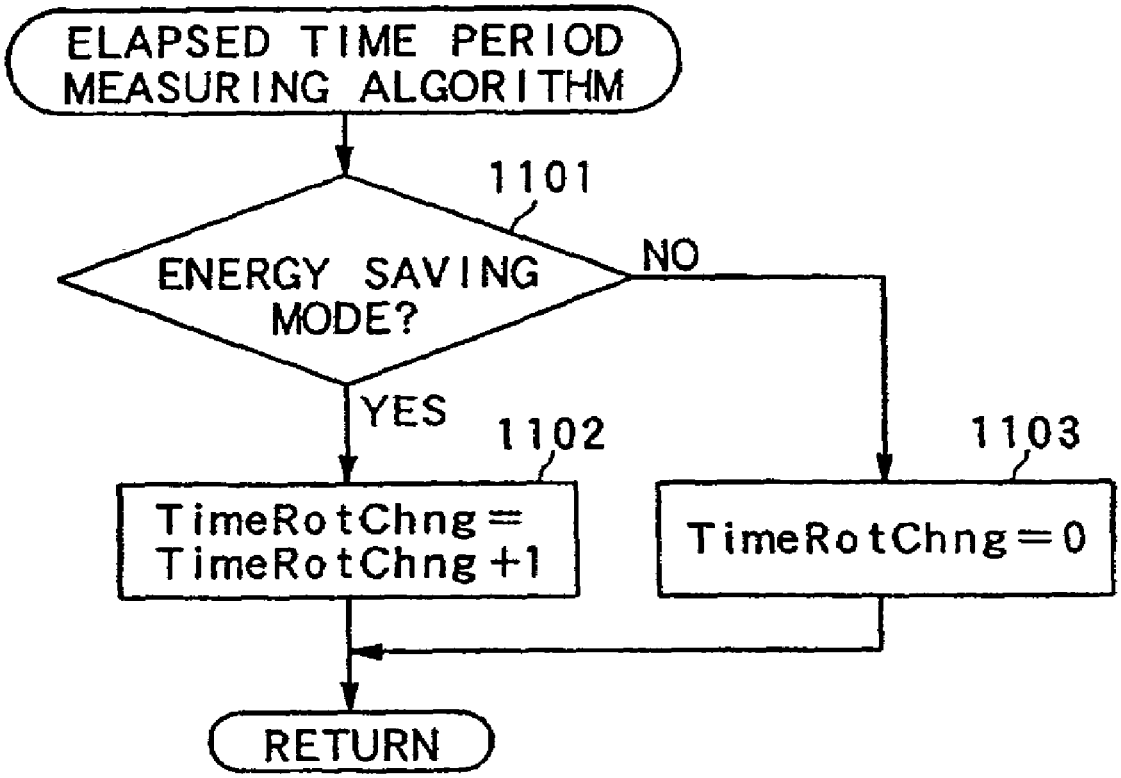
FIG. 12 is a flowchart showing an elapsed time measuring algorithm.

FIG. 12 is a flowchart showing an elapsed time period measuring algorithm. The processing is executed by the CPU 501 (program) repeatedly at each constant time period. The function of the CPU 501 corresponds to a measuring unit of the example.

First, it is determined whether the mode of the image forming apparatus is the energy saving mode (step 1101). In the case of the energy saving mode, 1 is added to the value of the interval switch timer TimeRotChng (step 1102). On the other hand, when the mode is not the energy saving mode, the interval switch timer TimeRotChng is reset 0 (step 1103). By the processing, the elapsed time period from switching the mode can be measured.

According to the above-described constitution of the embodiment, after shifting from the standby mode to the energy saving mode, the nip position change operation is executed in accordance with the actual temperature of the fixing roller and therefore, the compression set can effectively be restrained. Further, power consumption can be reduced since the drive power source of driving the fixing motor is shut off in the energy saving mode. Further, after the temperature of the fixing roller is lowered, the frequency of the nip position change operation is reduced and therefore, deterioration in the power source parts by repeating to start up/shut off the drive power source can be minimized.

Further, the above-described embodiment only exemplifies a specific example of the present invention. The scope of the invention is not limited to the above-described embodiment but includes various modifications within the scope of the technical ideas thereof.

For example, although according to the above-described embodiment, only one stage of switching the nip position change interval is carried out in the energy saving mode, it is preferable to switch the interval by two stages or more by increasing a number of data of the interval table TblRotIntvl (for example, 5 minutes, 8 minutes, 10 minutes).

According to the above-described embodiment, the nip position change operation can efficiently and properly be executed in the energy saving mode and therefore, the restraint of the compression set and the reduction of the power consumption can be made to be compatible, further, an effect of reducing the load on the power source parts can be expected.

This application claims priority from Japanese Patent Application No. 2004-167231 filed Jun. 4, 2004, which is hereby incorporated by reference herein.

What is claimed is:

1. An image forming apparatus comprising:

an image forming unit that forms an image on a recording material;

first and second rotating members that heat the image on the recording material at a nip portion formed therebetween;

an executing unit capable of executing a processing of rotating the first and second rotating members at standby which includes a standby mode and a low power mode in which power consumption is smaller than in the standby mode;

a measuring unit that measures an elapsed time period since switching from the standby mode to the low power mode; and a changing unit that changes a time interval of executing the processing in the low power mode in accordance with the elapsed time, wherein the time interval when the elapsed time period is less than a predetermined time period is shorter than the time interval when the elapsed time period is equal to or longer than the predetermined time period.

2. An image forming apparatus according to claim 1, wherein in the standby mode, a temperature of the rotating member is maintained at a first temperature capable of forming the image and in the low power mode, a temperature of the rotating member is maintained at a second temperature lower than the first temperature.

3. An image forming apparatus according to claim 1, wherein the executing unit executes the processing such that a position of forming the nip portion of the first and second rotating members is changed.

4. An image forming apparatus according to claim 1, wherein the first rotating member includes a rubber layer.

* * * * *

UNITED STATES PATENT AND TRADEMARK OFFICE

CERTIFICATE OF CORRECTION

PATENT NO. : 7,120,371 B2
APPLICATION NO. : 11/081723
DATED : October 10, 2006
INVENTOR(S) : Takashi Fujimori It is certified that error appears in the above-identified patent and that said Letters Patent is hereby corrected as shown below:

ON THE TITLE PAGE, AT ITEM (56) RC:
Foreign Patent Document, "01052185 A" should read --01-052185 A--.

COLUMN 2:
Line 1, "other" should read --another--.
Line 4, "other" should read --another--.

COLUMN 4:
Line 9, "processing)" should read --processing).--.
Line 12, "of" (first occurrence) should be deleted.
Line 28, "more" should read --greater--.
Line 30, "and" should read --to measure--.
Line 32, "staeted to measure." should read --started.--.

COLUMN 6:
Line 34, "device" should read --devices--.

COLUMN 7:
Line 54, "being failed" should read --failing--.

COLUMN 8:
Line 11, "sensor" should read --sensors--.

COLUMN 9:
Line 4, "starting to print." should read --print start.--.

UNITED STATES PATENT AND TRADEMARK OFFICE

CERTIFICATE OF CORRECTION

PATENT NO. : 7,120,371 B2
APPLICATION NO. : 11/081723
DATED : October 10, 2006
INVENTOR(S) : Takashi Fujimori It is certified that error appears in the above-identified patent and that said Letters Patent is hereby corrected as shown below:

COLUMN 11:
Line 45, "reset" should read --reset to--.
Line 58, "to" should be deleted.
Line 59, "the" should read --of the--.

Signed and Sealed this

Tenth Day of April, 2007

JON W. DUDAS
*Director of the United States Patent and Trademark Office*